US007331262B2

(12) United States Patent
Petit et al.

(10) Patent No.: US 7,331,262 B2
(45) Date of Patent: Feb. 19, 2008

(54) DRIVE BIT HOLDER AND METHOD OF MANUFACTURING

(75) Inventors: Christophe Petit, Chicago, IL (US); Timothy T. Herrick, Plainfield, IL (US)

(73) Assignee: SK Hand Tool Corporation, McCook, IL (US)

( * ) Notice: Subject to any disclaimer, the term of this patent is extended or adjusted under 35 U.S.C. 154(b) by 0 days.

(21) Appl. No.: 11/213,708

(22) Filed: Aug. 30, 2005

(65) Prior Publication Data

US 2007/0044602 A1 Mar. 1, 2007

(51) Int. Cl.
*B25B 23/00* (2006.01)
*B25B 23/16* (2006.01)

(52) U.S. Cl. ..... 81/438; 81/439; 81/177.85

(58) Field of Classification Search ..... 81/438–440, 81/177.85, 121.1, 125, 462, 124.4, 124.5, 81/124.6, 53.2
See application file for complete search history.

(56) References Cited

U.S. PATENT DOCUMENTS

| | | | | |
|---|---|---|---|---|
| 1,375,767 | A | 4/1921 | Baldus | |
| 1,595,588 | A | 8/1926 | Tuttle | |
| 1,772,723 | A | 8/1930 | Klein | |
| 2,027,922 | A | 1/1936 | McNaught | |
| 2,340,529 | A | 2/1944 | Hartman | |
| 2,367,942 | A | 1/1945 | Hartman | |
| 2,397,382 | A | 3/1946 | Smith | |
| 2,417,569 | A | 3/1947 | Rice | |
| 2,457,451 | A | 12/1948 | Domack | |
| 2,788,690 | A | 4/1957 | Able | |
| 2,806,706 | A * | 9/1957 | Fitch | 279/79 |
| 2,833,548 | A * | 5/1958 | Clark | 279/102 |
| 3,962,899 | A | 6/1976 | Hubbell | |
| 4,061,013 | A | 12/1977 | Kuc et al. | |
| 4,078,415 | A | 3/1978 | Koch et al. | |
| 4,166,373 | A | 9/1979 | Braun | |
| 4,217,771 | A | 8/1980 | Braun | |
| 4,291,568 | A | 9/1981 | Stifano, Jr. | |
| 4,535,658 | A * | 8/1985 | Molinari | 81/177.85 |
| 4,594,874 | A | 6/1986 | Bononi et al. | |
| 4,607,547 | A * | 8/1986 | Martus | 81/53.2 |
| 4,941,862 | A * | 7/1990 | Hazebrook et al. | 464/141 |
| 5,295,423 | A * | 3/1994 | Mikic | 81/438 |
| 5,341,705 | A * | 8/1994 | Lin | 81/438 |
| 5,375,449 | A | 12/1994 | Bononi | |
| 5,918,512 | A * | 7/1999 | Habermehl et al. | 81/438 |
| 5,954,463 | A * | 9/1999 | Jore | 408/239 R |
| 5,960,681 | A * | 10/1999 | Anderson et al. | 81/125 |
| 6,003,411 | A * | 12/1999 | Knox et al. | 81/53.2 |
| 6,240,813 | B1 | 6/2001 | Hyatt | |
| 6,390,929 | B2 | 5/2002 | Hyatt | |
| 6,609,862 | B2 * | 8/2003 | Mowins | 408/226 |
| 6,626,067 | B1 | 9/2003 | Iwinski et al. | |
| 2001/0007213 | A1 | 7/2001 | Hyatt | |

* cited by examiner

*Primary Examiner*—Joseph J. Hail, III
*Assistant Examiner*—Bryan R. Muller
(74) *Attorney, Agent, or Firm*—Greenblum & Bernstein, P.L.C.

(57) ABSTRACT

A bit holder is provided which includes a body having a cavity formed with an upper portion and a lower portion, separated by a ridge-like protuberance which has a cross sectional profile smaller than that of the upper portion and the lower portion. The ridge-like protuberance is formed on each sidewall of the cavity to form an interference fit. A method of manufacture includes the use of a punch to force material from the upper portion downwards towards the lower portion of the cavity to form the ridge-like protuberance.

18 Claims, 4 Drawing Sheets

DRIVE BIT HOLDER AND METHOD OF MANUFACTURING

FIELD OF THE INVENTION

The invention relates to a socket bit holder, and more particularly, to a socket driver with tool bit retaining members for retaining the tool bits therein and a method of manufacture.

BACKGROUND DESCRIPTION

Socket-type tools, e.g., wrenches, are used widely in many applications from automotive, to plumbing to a host of other applications. In these applications it is important for the bit, e.g., drill, socket, etc., to remain engaged with the socket driver during use. This ensures not only proper use of the tool, but also maintains safe handling of the tool during its use. It, of course, is of the utmost importance from a tooling manufacturer's perspective to ensure that the user is safe while using the tool.

To ensure that the bit is retained within the socket during use, manufactures have devised methods to retain the bit within the socket. Many of these methods are also designed to allow the bit driver to separate from the socket so as to allow replacement or interchangeability of the bit. However, an overriding concern when designing such a semi permanent engagement mechanism, which allows for interchanging or replacing the bit for a particular application, is to ensure that the bit driver and the socket remain in coupling engagement with each other during normal use.

One approach for coupling a drive bit to a drive socket, for example, is the use of a coupling pin. Although this approach ensures that the drive bit remains in the socket, it does require separate parts, e.g., a pin, and additional manufacturing tolerances and steps which greatly increase its costs. By way of illustration, the manufacturing tolerances must be such so as to allow the transverse holes of the bit and socket to perfectly aligned and be accurately sized to allow the pin to be placed therein for securing the bit within the socket. If alignment is not perfect, the pin may become loose and fall out or may be sheared in use. This method is also cumbersome, since the pin has to always be removed in order to replace the bit.

Other known methods include a spring-biased ball which can be engaged within the socket or the bit, itself. In either of these approaches, when the bit is inserted into the socket, the ball will be biased into a complimentary recess for holding the bit within the socket. Although this approach may be effective, it is still costly to manufacture due to the added parts required for the assembly, in addition to the actual cost of manufacturing the bit socket, itself. Also, it is known that the spring becomes worn, after many uses, which can contribute to the failure of the engagement between the two parts.

U.S. Pat. No. 5,960,681 is very illustrative of many examples of different types of retaining members, some of which are described above. In the background section, this patent describes additional methods including, for example, the use of a friction ring for bit detention. U.S. Pat. No. 5,960,681 describes such a system as simplifying the changing of the bit, but does not provide a very secure retention. U.S. Pat. No. 5,960,681 additionally describes a number of patents which use "O" rings intended to engage with recesses or regions of a tool bit, as well as a bit with frictional retention in the drive socket in which appropriate recesses are provided in the flat surfaces of the bit itself.

Lastly, in the detailed description, U.S. Pat. No. 5,960,681 describes protuberances on alternate walls of the socket, i.e., an important feature is that the protuberances 24*a*-34*c* are arranged on alternate or successive ones of the flat surfaces 28-33, so that diametrically opposing surfaces always include one such surface which is provided with a protuberance and the opposing surface is without a protuberance. According to U.S. Pat. No. 5,960,681, the protuberances are in the form of inwardly projecting bosses or projections which are generally flat. The protuberance are formed by a broaching tool which moves some material to the bottom of the cavity such that the remaining material, e.g., the material which is not moved, forms the protuberances.

SUMMARY OF THE INVENTION

In a first aspect of the invention, a bit holder comprises a body having a cavity formed with an upper portion and a lower portion, separated by a ridge-like protuberance which has a cross sectional profile smaller than that of the upper portion and the lower portion. The ridge-like protuberance is formed on each sidewall of the cavity to form an interference fit.

In another aspect of the invention, the bit holder includes a body having a cavity formed with an upper portion and a lower portion, separated by a protuberance formed on each of the sidewalls of the cavity. The upper portion has concave surfaced sidewalls and the lower portion has substantially flat surfaced sidewalls forming a substantially uniform predetermined polygonal cross-section. The protuberance formed on each of the sidewalls, taken together, form a cross section smaller than that of the upper portion and an opposing flat-to-flat surface of the lower portion.

BRIEF DESCRIPTION OF THE DRAWINGS

The foregoing and other aspects and advantages will be better understood from the following detailed description of embodiments of the invention with reference to the drawings, in which.

DESCRIPTION OF THE EMBODIMENTS OF THE INVENTION

The invention is directed to a socket driver (bit holder) capable of semi-permanently retaining driver bits. The bit holder of the invention does not require any additional parts in order to retain driver bits therein. The bit holder is of simple construction and can be manufactured very economically, compared to other known apparatus.

The bit holder of the invention includes a cavity designed to hold a bit driver. The cavity includes an upper portion and a lower portion, with a ridge or burr-like structure (e.g., retaining member) or burr separating the upper portion and the lower portion. The lower portion of the cavity is dimensioned to match the exterior shape of the bit driver to be inserted therein. The upper portion is substantially hexagonal in shape, but with slightly concave surfaces or walls. The retaining member is located on each wall of the cavity, forming substantially a loop about a perimeter of the cavity, which may be continuous or have intermittent spaces as described below. The retaining member has a smaller cross sectional profile (e.g., circumference) than the flat-to-flat dimension of the lower portion. This will act as a retaining means for the bit driver, since the diameter of the protuberance will be slightly smaller than the outer dimension of the bit driver.

Figure 1:
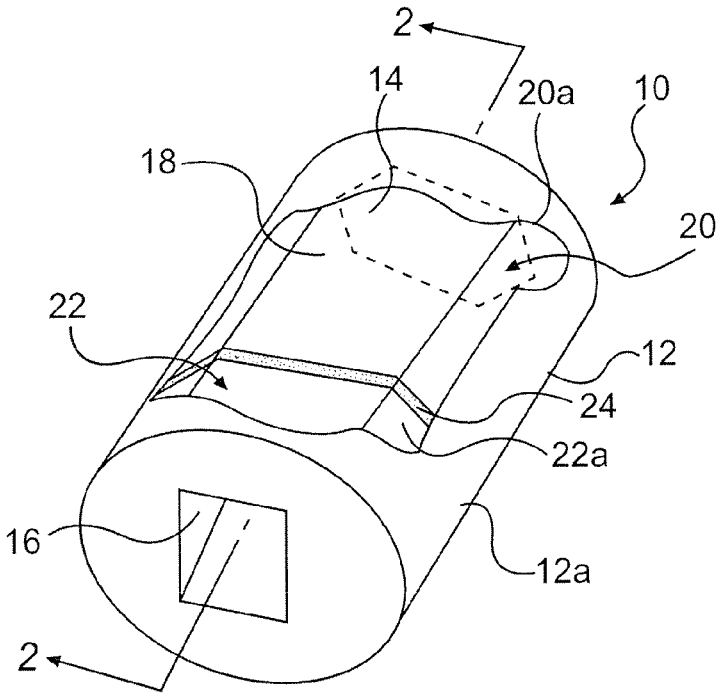
FIG. 1 is a perspective partial cut-away plan view of a bit holder in accordance with the invention.

FIG. 1 is a perspective partial cut-away plan view of a socket driver in accordance with the invention. The socket driver in accordance with the invention is generally designated by reference numeral 10. The bit holder 10 includes a body 12 having a generally circular outer wall 12*a*. The bit holder 10 has opposing open axial ends 14, 16. The open end 14 has an opening for coupling the body 12 to a bit driver (not shown) during use. The open axial end 16 is generally a square opening, which is designed to accommodate an end of a driver, e.g., ratchet drive square.

Still referring to FIG. 1, the open axial end 14 leads to a cavity 18 designed to accommodate the bit driver. The cavity 18 includes an upper portion 20 and a lower portion 22, separated by a burr-like or ridge-like protuberance 24. In one embodiment, the burr-like or ridge-like protuberance 24 is provided on each of the sidewalls of the cavity 18. In another embodiment, the burr-like or ridge-like protuberance 24 is formed from moved material during the manufacturing process, and forms a loop about the entirety or substantially the entirety of the cavity 18, separating the upper portion 20 and the lower portion 22. In an embodiment, the burr-like or ridge-like protuberance 24 spans substantially along a width (about the horizontal) of each of the sidewalls forming a loop with intermittent spaces "S" formed at predetermined sections close to adjoining areas of some or all of the sidewalls, depending on manufacturing processes.

In the lower portion 22, each of the sidewalls comprises a substantially flat surface 22*a*, which form a receiving space of substantially uniform hexagonal cross section. In one embodiment, the receiving space can be designed to any shape to accommodate any exterior shape of a bit driver. In the upper portion, 20, each of the sidewalls includes a concavity 20*a*, which is formed by the manufacturing process.

Figure 2:
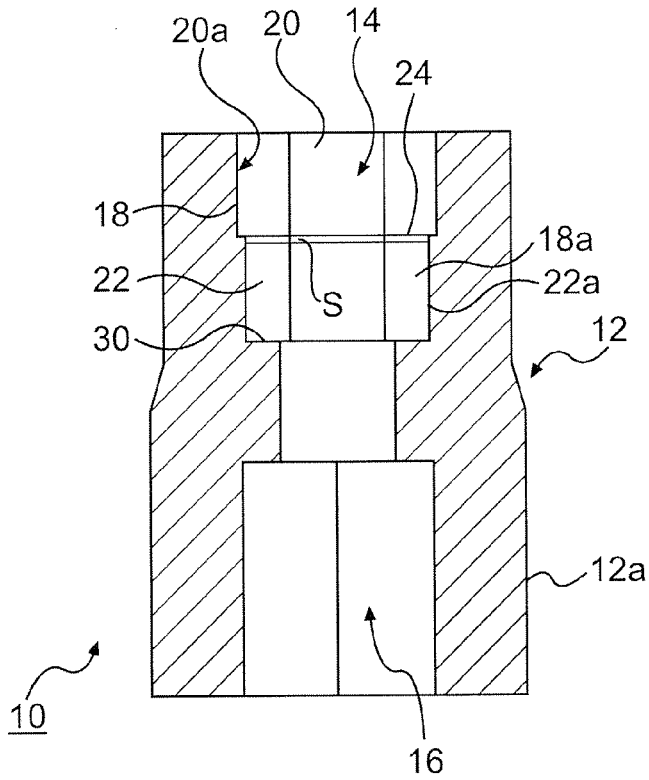
FIG. 2 is a cross sectional view of the bit holder shown in FIG. 1, taken along line 2-2.

As shown in FIG. 2, the burr-like or ridge-like protuberance 24 acts as a retaining means, which projects into the cavity 18 to establish an interference fit when the bit driver shank is inserted into the cavity. As shown in FIG. 2, the burr-like or ridge-like protuberance 24 is a projection, which projects inwardly towards the center of the opening. The protuberance, in embodiments, also has a substantially rounded or non-flat surface which is adapted to engage the bit driver. This surface configuration is mainly due to the manufacturing process, which moves material in order to form the burr-like or ridge-like protuberance 24. The protuberance also has a substantially flat upper surface or a slight angle downward, provided by the shape of the punch which moves the material.

As further shown in FIG. 2, the burr-like or ridge-like protuberance 24 is arranged on each of the surfaces of the cavity. In embodiments, the burr-like or ridge-like protuberance 24 may also extend within the corners formed from the intersection of the walls forming the cavity. In one embodiment, the burr-like or ridge-like protuberance 24 is formed approximately at an intermediate position between the open end of the bit holder and an end stop or ledge formed within the cavity. The ledge 30, as should be understood by those of skill in the art, will act as a stop for the bit driver during the insertion thereof.

The retaining forces of the burr-like or ridge-like protuberance 24 are a function of the surface area of contact between the surfaces of a driven end of the bit driver and the burr-like or ridge-like protuberance 24. Thus, with the increased surface area contact between the formed burr-like or ridge-like protuberance 24 due to its placement on all of the walls of the bit holder, increased retention forces are achieved with the invention (as compared to having no interference).

Figure 3:
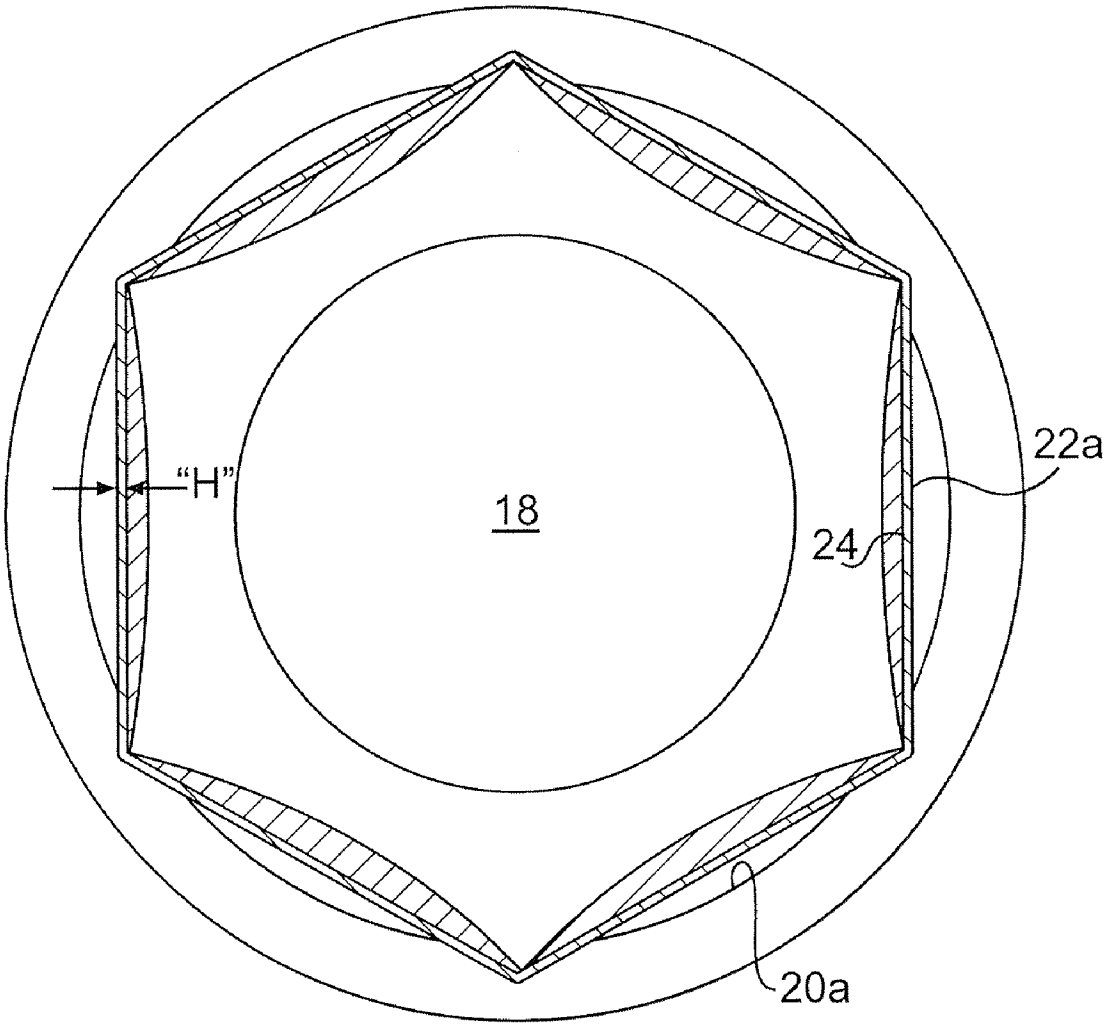
FIG. 3 is a diagrammatic representation of the interior walls of the bit holder in accordance with the invention.

FIG. 3 is a diagrammatic representation of the interior walls of the bit driver in accordance with the invention. As seen in this representation, the upper portion 20 of the bit holder includes concave wall sections 20*a*. The lower portion 22 includes substantially flat wall surfaces 22*a*, which are dimensioned to correspond with an exterior shape of the bit, itself. The burr-like or ridge-like protuberance 24, taken as a whole, has a smaller cross sectional profile than the flat to flat dimension of the lower portion such that it will act as a retaining means for the bit driver. The burr-like or ridge-like protuberance 24 is of sufficient height "H" to permit insertion of a bit driver into the cavity while providing retaining forces on the bit driver to render the attachment or coupling therebetween semi-permanent.

Figure 4:
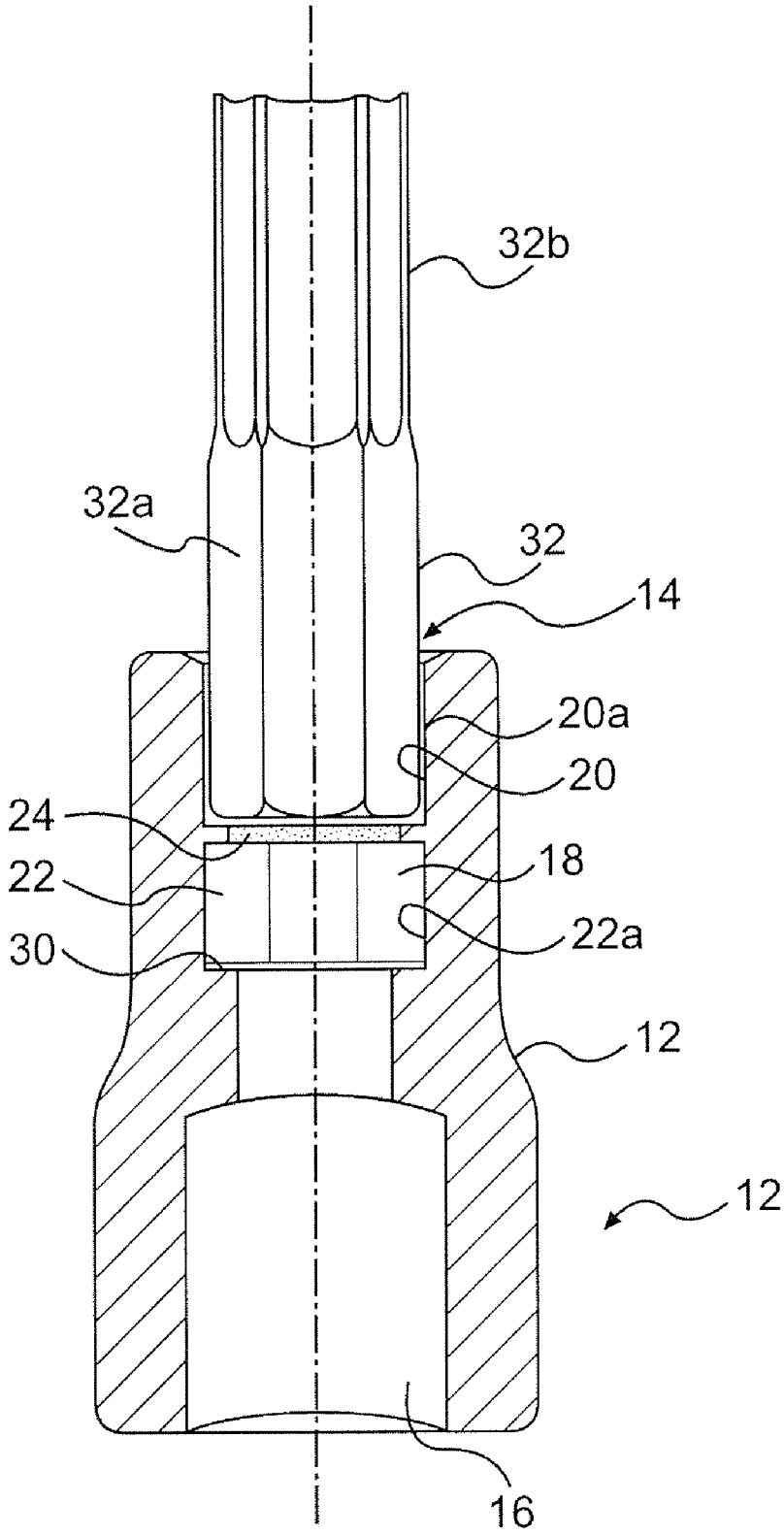
FIG. 4 is a cross sectional view of a bit holder in accordance with the invention with a bit driver being inserted therein.

FIG. 4 is a cross sectional view of a bit holder in accordance with the invention with a bit driver 32 being inserted therein. The bit driver 32 has a shank or driven end 32*a* and a free driving end 32*b*, which can be, for example, screwdriver blade, hex driver, etc. As should be understood, the burr-like or ridge-like protuberance 24 forms a space that is smaller than an exterior dimension of the bit driver 32, at the driven end 32*a*. The bit driver 32 can be inserted to a stopping end or ledge 30.

The driven end 32*a* is initially inserted into the cavity 18, with a slight clearance between the concave surfaces of the upper portion 20. As the driven end 32*a* encounters the burr-like or ridge-like protuberance 24, the end 32*a* engages the burr-like or ridge-like protuberance 24, which, in turn, begins to wedge the driven end 32*a* within the cavity 18.

Once fully inserted, the bit driver 32 is semi permanently coupled to the bit holder 10. The bit driver 32 can be removed by inserting a tool through the cavity and into contact with the bit driver 32, and overcoming the retaining forces due to the interference fit.

Thus, as shown in FIG. 4, the forceful insertion of the bit driver 32 into the cavity 18 will result in an interference fit with the burr-like or ridge-like protuberance 24 applying forces against the driven end 32*a*. The forces urge the driven end 32*a* against the surfaces of the burr-like or ridge-like protuberance 24 to create a semi-permanent coupling between the bit driver 32 and the bit holder 10. These forces are sufficient to maintain a degree of retention on the driven bit driver within the bit holder.

METHOD OF MANUFACTURE

In one exemplary illustration, the burr-like or ridge-like protuberance of the invention is formed by punches. For example, a broaching tip of a broaching tool has dimensions selected so as to remove material from the wall of the upper portion and force it downward to form the burr-like or ridge-like protuberance. Of course, other methods for providing the interference or burr of the invention within a socket driver are contemplated for use by the present invention.

Figure 5A:
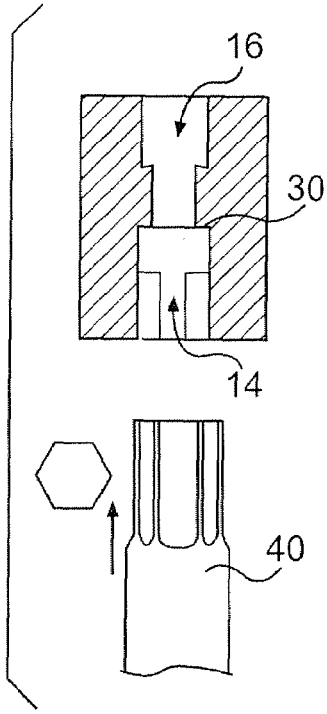
FIGS. 5*a*-5*d* illustrate steps for manufacturing a bit holder in accordance with the invention.
Figure 5C:
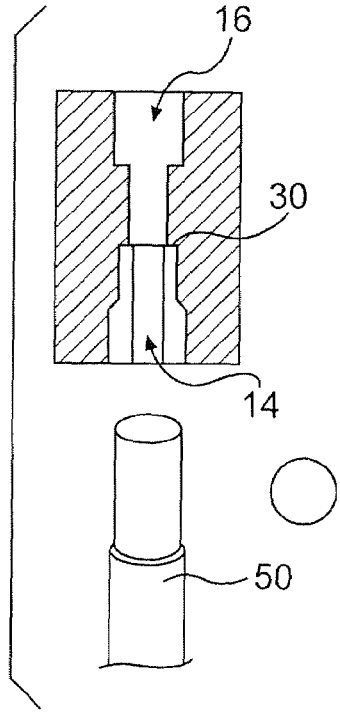
Figure 5B:
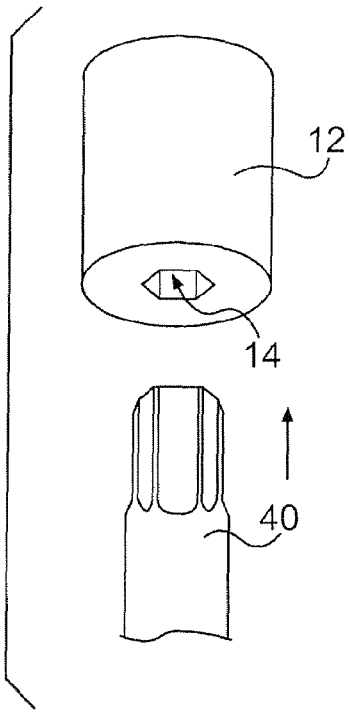

Referring now to FIGS. 5*a* and 5*b*, in order to form the protuberance of the bit holder, a first punch 40 is used to initially form the cavity. This punch 40 is preferably the shape and slightly larger in size than the outer dimension of the bit driver. The punch 40 may be used to form the open end 14 for receiving a bit driver and an interior, stopping end or ledge 30.

Figure 5D:
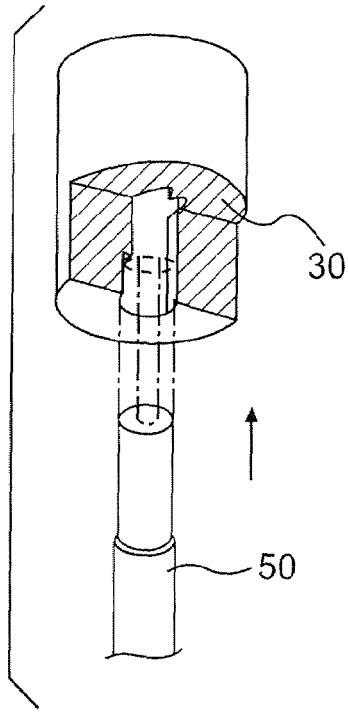

As shown in FIGS. 5*c* and 5*d*, a round punch 50 is used to form the protuberance by moving material in the upper portion of the cavity towards the lower portion. Specifically, the round punch has a diameter slightly larger than the flat-to-flat dimension of the already formed cavity. The round punch 50 is aligned with the cavity and moved downward in the cavity. As the round punch is moved downward, it moves material from all of the walls of the cavity. This "excess" material forms the protuberance about all of the walls of the cavity, separating the upper portion and the lower portion. The material will form a diameter or cross section, which is slightly smaller than the outer dimension of the bit driver, thus creating a retaining member, e.g., interference, for the bit driver as it enters and remains within the cavity. The lower portion of the cavity will retain its original shape.

It should be understood, although not shown, that punches may be used to form the open end 16. In one implementation, this punch has a square cross section to form the coupling to the socket wrench, itself. This or another punch may be used to form a passage between the cavity and the open end 14.

While the invention has been described in terms of exemplary embodiments, those skilled in the art will recognize that the invention can be practiced with modifications and in the spirit and scope of the appended claims.

It is claimed:

1. A bit holder comprising a body having a cavity formed with an upper portion and a lower portion, separated by a ridge-like protuberance comprising material from the upper portion, the upper portion having a plurality of side walls, each sidewall having a concave wall and alternating pairs of flat portions that meet the flat portions of adjacent sidewalls to form an angle therebetween, and which has a cross sectional profile smaller than that of the upper portion and the lower portion, the ridge-like protuberance being formed on each sidewall of the cavity to form an interference fit with a shank of a bit, wherein the ridge-like protuberance is monolithic with the upper portion and the lower portion and made from a same type of material thereof.

2. The bit holder of claim 1, wherein the ridge-like protuberance has a substantially non-flat surface which is adapted to contact a bit driver.

3. The bit holder of claim 1, wherein the lower portion includes sidewalls which have a substantially flat surface.

4. The bit holder of claim 1, wherein the ridge-like protuberance is a burr.

5. The bit holder of claim 1, wherein the ridge-like protuberance, upon forceful insertion of a bit driver shank, provides a mechanism for retaining the driver bit with the cavity.

6. The bit holder of claim 1, wherein the upper portion and the lower portion form a receiving space.

7. The bit holder of claim 6, wherein the upper portion and the lower portion each have different cross sectional shapes.

8. The bit holder of claim 7, wherein the lower portion is formed of a plurality of flat substantially parallel surfaces together forming a receiving space of substantially uniform predetermined polygonal cross-section.

9. The bit holder of claim 1, wherein the upper portion and the lower portion are dimensioned to receive the shank of the bit which has a polygonal cross-section corresponding to a predetermined polygonal cross-section of the lower portion.

10. The bit holder of claim 1, wherein the ridge-like protuberance projects inwardly toward the cavity from each sidewall of the cavity to establish the interference fit between the bit and the ridge-like protuberance when the bit is inserted into the cavity.

11. The bit holder of claim 1, wherein the lower portion has a polygonal cross-section.

12. The bit holder of claim 1, wherein the ridge-like protuberance forms a substantially continuous loop about the sidewalls of the cavity.

13. The bit holder of claim 1, wherein the ridge-like protuberance is formed approximately at an intermediate position between an open end for receiving a bit driver and an interior stopping end.

14. A bit holder comprising a body having a cavity formed with a plurality of sidewalls, an upper portion and a lower portion, separated by a substantially continuous protuberance formed on each of the sidewalls of the cavity, the upper portion having a plurality of side walls, each sidewall having a concave wall and alternating pairs of flat portions that meet the flat portions of adjacent sidewalls to form an angle therebetween the lower portion having substantially flat surfaced sidewalls forming a substantially uniform predetermined polygonal cross-section, the protuberance formed on each of the sidewalls, taken together, have a cross section smaller than that of the upper portion and an opposing flat to flat surface of the lower portion, wherein the substantially continuous protuberance is monolithic with the upper portion and the lower portion and made from a same type of material thereof.

15. The bit holder of claim 14, wherein the protuberance spans substantially along a width of each sidewall to form a substantially continuous loop about the cavity.

16. The bit holder of claim 15, wherein the substantially continuous loop includes at least one space formed at a predetermined section close to adjoining areas of some or all of the sidewalls.

17. The bit holders of claim 16, wherein the upper portion and the lower portion form a receiving space, and the upper portion and the lower portion each has different cross sectional shapes.

18. The bit holder of claim 14, wherein each protuberance projects inwardly within the cavity to establish an interference fit between a driver bit shank and the protuberance on each sidewall when the driver bit shank is inserted into the cavity.

* * * * *